United States Patent [19]

Fischer

[11] 4,370,927

[45] Feb. 1, 1983

[54] PAPER WEB THREADING APPARATUS FOR ROTARY PRINTING MACHINES

[75] Inventor: Hermann Fischer, Augsburg, Fed. Rep. of Germany

[73] Assignee: M.A.N.-ROLAND Druckmaschinen Aktiengesellschaft, Offenbach am Main, Fed. Rep. of Germany

[21] Appl. No.: 256,133

[22] Filed: Apr. 21, 1981

[30] Foreign Application Priority Data

Apr. 23, 1980 [DE] Fed. Rep. of Germany ..... 8011068

[51] Int. Cl.[3] ..... B41F 13/02

[52] U.S. Cl. ..... 101/228; 226/92

[58] Field of Search ..... 101/219, 228; 226/91, 226/92; 242/47.03; 118/37, 235; 354/319, 321

[56] References Cited

U.S. PATENT DOCUMENTS 3,127,079 3/1964 Allander ..... 226/92
3,995,553 12/1976 Winterholler et al. ..... 101/228
4,063,505 12/1977 Sassamoto et al. ..... 101/228
4,111,122 9/1978 Kutzner et al. ..... 101/228

FOREIGN PATENT DOCUMENTS 2241127 4/1976 Fed. Rep. of Germany ..... 101/228

*Primary Examiner*—J. Reed Fisher
*Attorney, Agent, or Firm*—Frishauf, Holtz, Goodman & Woodward

[57] ABSTRACT

To permit free selection of a threading path in a printing machine of the threading element, the threading element (14) has a cross section such that the resistance against bending of the element in any direction—with respect to the longitudinal extent thereof—is at least approximately equal; a suitable element is a cable, a spiral spring, rope or the like. The threading element is guided in a threading path by tubular threading guides and can be selectively placed in various paths by switches positioned in the threading path, and moved in the threading path by engagement with friction drive wheels.

15 Claims, 14 Drawing Figures

PAPER WEB THREADING APPARATUS FOR ROTARY PRINTING MACHINES

The present invention relates to a threading apparatus for rotaary printing machines, and more particularly to apparatus in which a flexible pulling or threading carrier element is guided in a guide path by a tubular guide element in which it is contained.

BACKGROUND

It has previously been proposed—see German Pat. No. 22 41 127—to provide apparatus to thread web-like material in rotary printing machines in which different threading paths can be selected. The different threading paths are determined by guide elements and switches located outside of the region of the the rollers or cylinders of the printing machine. A flexible threading element of elongated shape is guided along the guide path in accordance with the predetermined threading path of the web. The guide element can be moved longitudinally to-and-fro. The threading element generally used is a flat spring-like element which can bend in two directions from its major plane; slight additional bending transverse to the plane is possible by twisting the element.

In various machines it is difficult to position the threading element such that it is located in essentially a single plane extending transversely to the major plane of the threading spring which, usually, is made of spring metal.

THE INVENTION

It is an object to provide a threading apparatus for rotary printing machines which does not limit the threading path to essentially a single plane, so that the limitation on the positioning of the path due to the nature of the threading element can be avoided.

Briefly, the flexible threading element has a cross-sectional shape of such characteristics that the resistance against bending of the element in any direction, with respect to its longitudinal extent, is essentially the same or equal. Typically, the threading elements may have circular or polygonal cross-section and can be in form of a cable, rope, spiral spring, or the like.

The threading element which can bend in any direction permits placement of the threading path and the guide elements therefor without limitation and without constraint with respect to any particular change of direction of the path, or any particular direction of deflection. Thus, the threading path and the guide elements therefor can readily be adapted to various printing machines and to the space available in the machines for placement of the guide elements for the threading apparatus in accordance with the desired threading path.

DRAWINGS

Figure 1:
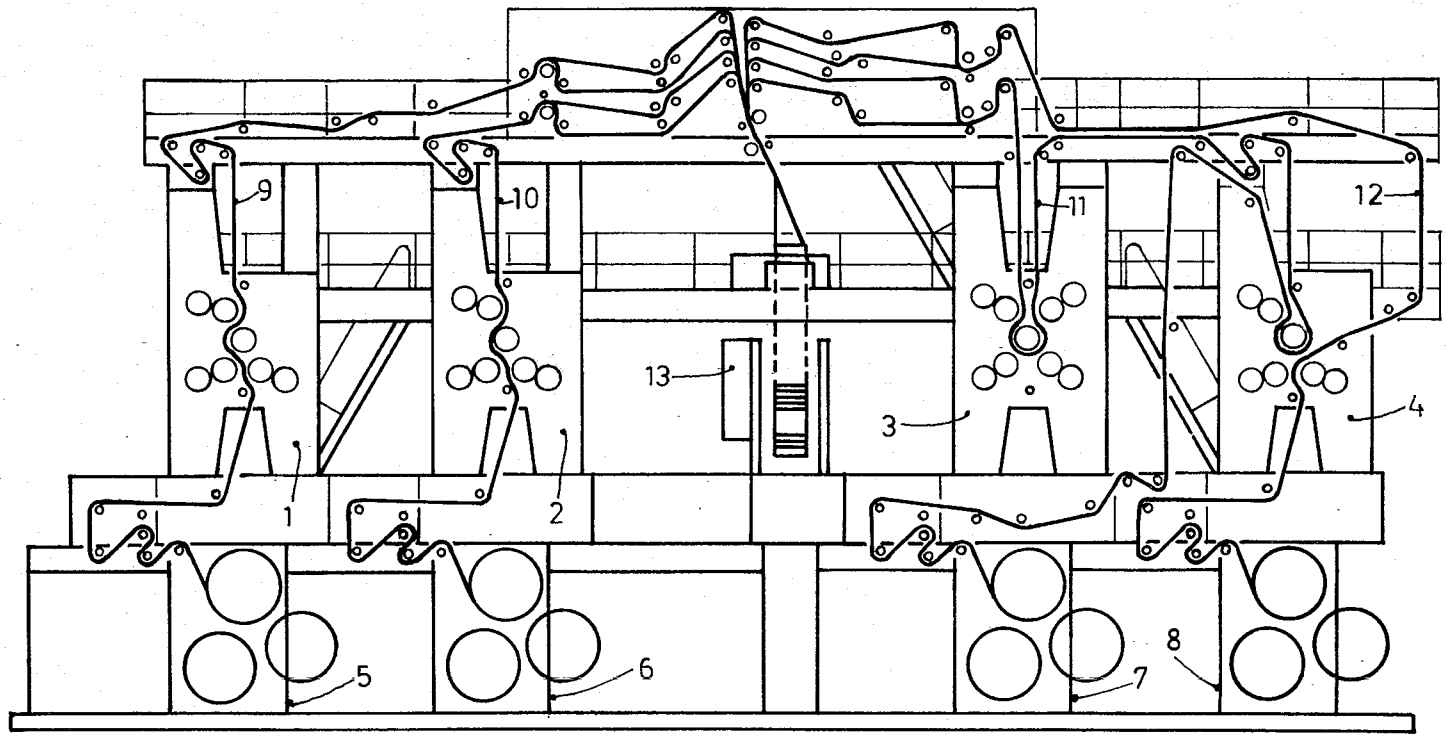
FIG. 1 is a highly schematic side view of a typical rotary printing machine illustrating various paths which a paper web can take when threaded through the machine.
Figure 13:
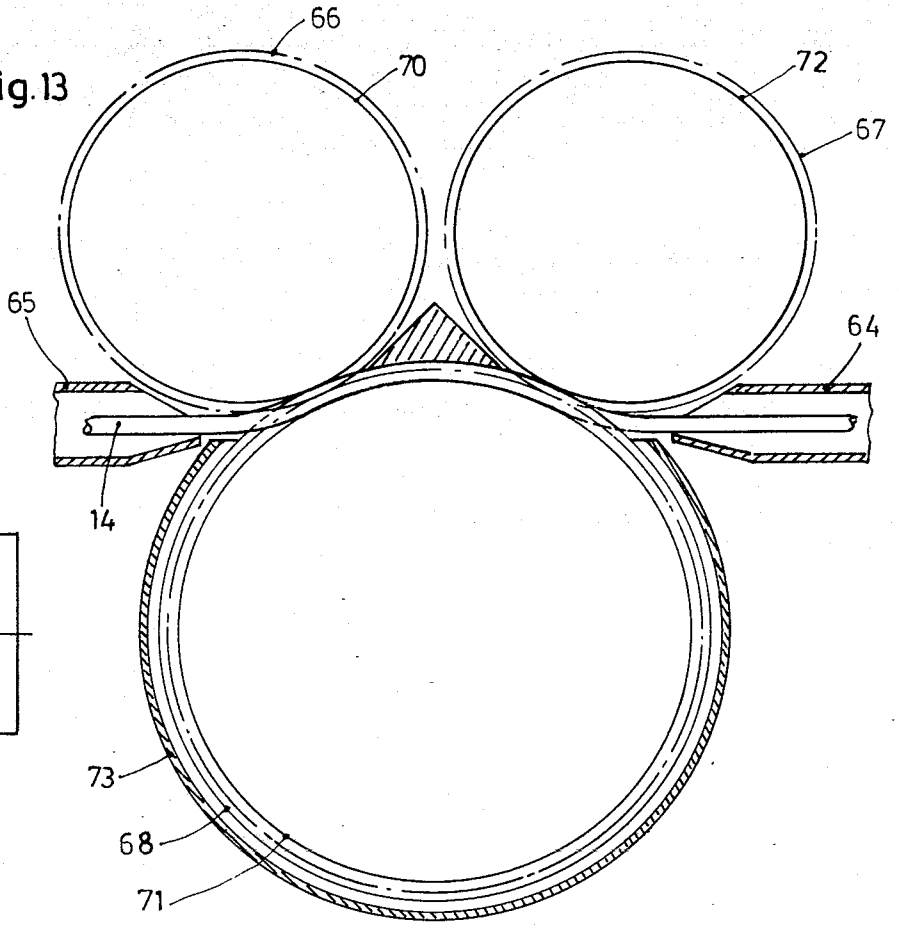

FIG. 13 is a schematic side view of a preferred form of cable threading apparatus; and FIG. 1 shows a known continuous web rotary offset printing machine in which many web paths are shown, which in part may be very complex. The printing stations 1, 2, 3, 4 print on paper webs 9, 10, 11, 12 supplied from paper supply spiders 5, 6, 7, 8. The webs are guided over guide and turn rods, not further identified, and, after suitable longitudinal slitting guided to a folding arrangement 13 in which to the respective requirements regarding the color to be printed on the upper and reverse side of the paper webs 9 to 12, the paper webs 9 to 12 are threaded between predetermined cylinders, not further referenced, of the printing stations 1 to 4. For clarity, printing and damping systems, as well as further necessary apparatus was not shown in the printing machines illustrated in FIG. 1. FIG. 1 shows the many possibilities and complex way in which paper web guiding s possible in modern printing machines, which frequently exceed by many multiples the machine shown in FIG. 1. The respective paper webs after having been printed at the printing stations are superposed and then folded or otherwise handled in a folding and treatment apparatus 13.

To thread the paper into the machine, a threading apparatus is used which includes an elongated threading element 14, guided in an elongated tubular guide element 15. The threading element 14 has attached thereto a web engaging element, typically a pull hook 16 (FIG. 3) which engages the paper web as it is pulled through the machine.

In accordance with a feature of the present invention, the pulling element 14 is a pulling rope or cable, guided in a guide tube 15 which is positioned in or on the printing machine in accordance with a desired threading path.

Upon occurrence of tears in the web of the material on which printing is to be effected, typically paper, disturbances in machine operation result which are difficult to clear. It is desirable to be able to match the threading paths for the threading elements to the respectively occurring local conditions within the machine. The present invention, and see particularly FIGS. 2 and 3, permits versatile placement of the threading element to pull a paper web through the machine, for example from positions where the web may have torn. The pulling cable or rope 14 permits universal placement of the pulling element. Rather than using a rope, a spiral may be used; the cross section of the pulling element may be circular, but a pulling element or cable of polygonal cross section may also be employed. The important feature of the element 14 is, however, that it can bend in any direction with essentially equal bending resistance, so that constraint with respect to any possible threading path by the shape of the threading element is avoided.

The cable 14 has a pulling hook 16 applied thereto which extends through slits 17 formed in the guide tubes 15 (see FIG. 2) on which hooks 16, for the paper web to be pulled through the machine can be attached, for example by clamps connected to the hooks 16 by a further cable, rope or hanger arrangement, as well known and in accordance with any suitable construction.

The cable 14 is pushed or pulled through the machine by drive rollers. Additionally, the cable 14 is guided in its threading path by friction rollers 20, 21—see FIG. 3. The friction rollers 20, 21 are located in portions at which the guide tube 15 is sectionalized or interrupted. At least one of the rollers, as shown the roller 21, has an outer circumference or is entirely made of hard rubber, and is resiliently pressed against the cable 14 by a spring 22. The cable 14 thus is reliably guided in its path. Synchronization between a plurality of friction roller pairs is not necessary since slip between the roller pairs and the cable may occur.

Figure 2:
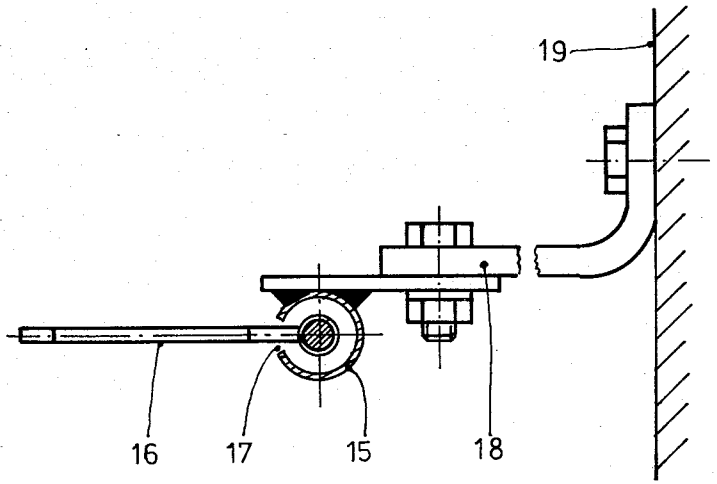
FIG. 2 is a highly schematic front view of the threading element.

The elongated, slitted tube sections are secured to frame portions of the machine 19 by suitable brackets 18—see FIG. 2. The tube sections can be welded to the brackets or extensions thereof and attached in any suitable manner, for example by bolts as shown.

Figure 4:
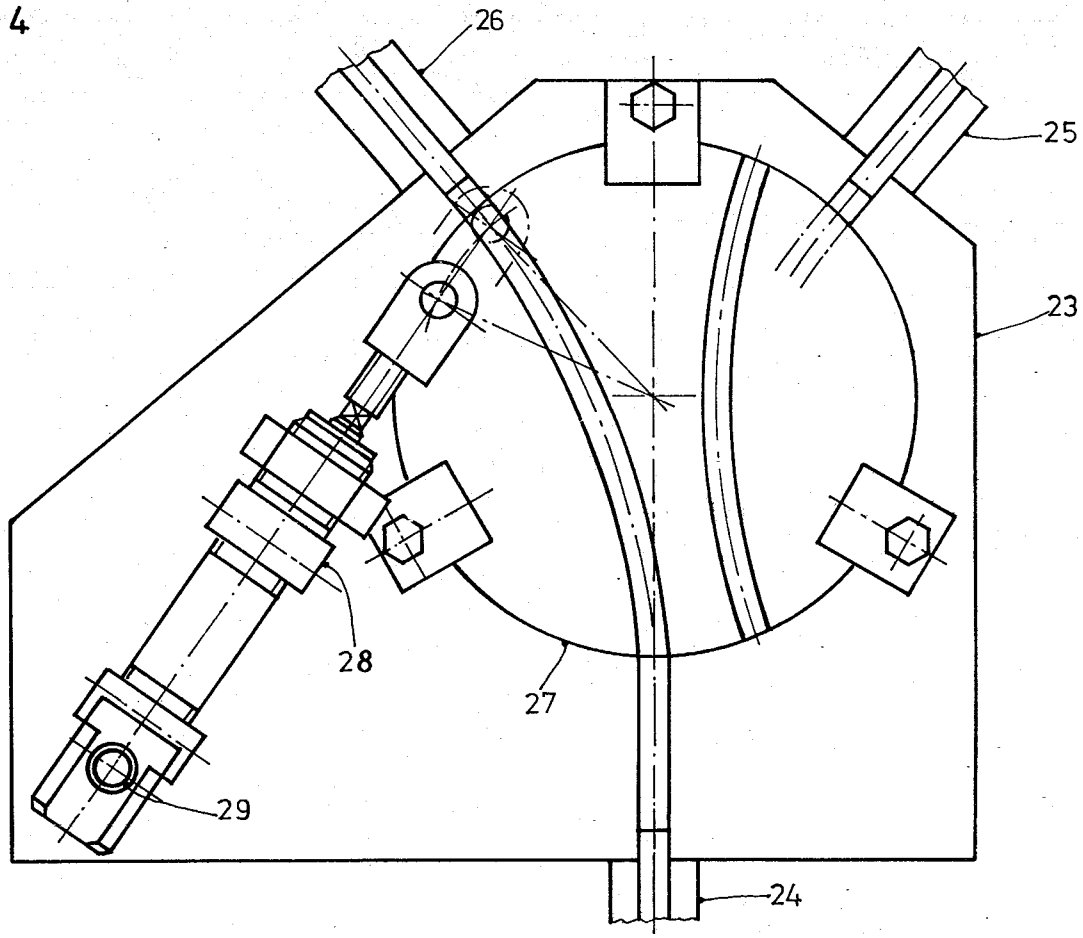
FIG. 4 is a schematic front view of a two-way switch.

The threading paths within the machine can be controlled by interposition of path switches in the threading path itself. Referring to FIG. 4: A switch 23 is shown which permits changing the threading path from a path portion 24, selectively, to path portions 25 or 26. A circular switching table 27 is rotatably located in a frame portion of the machine, or a similar suitable holding element. The rotary position of the switching table or disk 27 is controlled by application of force from a pneumatic or hydraulic cylinder 28, which is pivoted to the frame at a pivot point 29. As can be seen from FIG. 4, extension of the cylinder-piston element 28 from the position shown to the broken-line position of the attachment element of the cylinder-piston arrangement to the table 27 will switch the threading path from the continuing path 24–27≧26 to the other position (not shown) 24–27–25.

Figure 5:
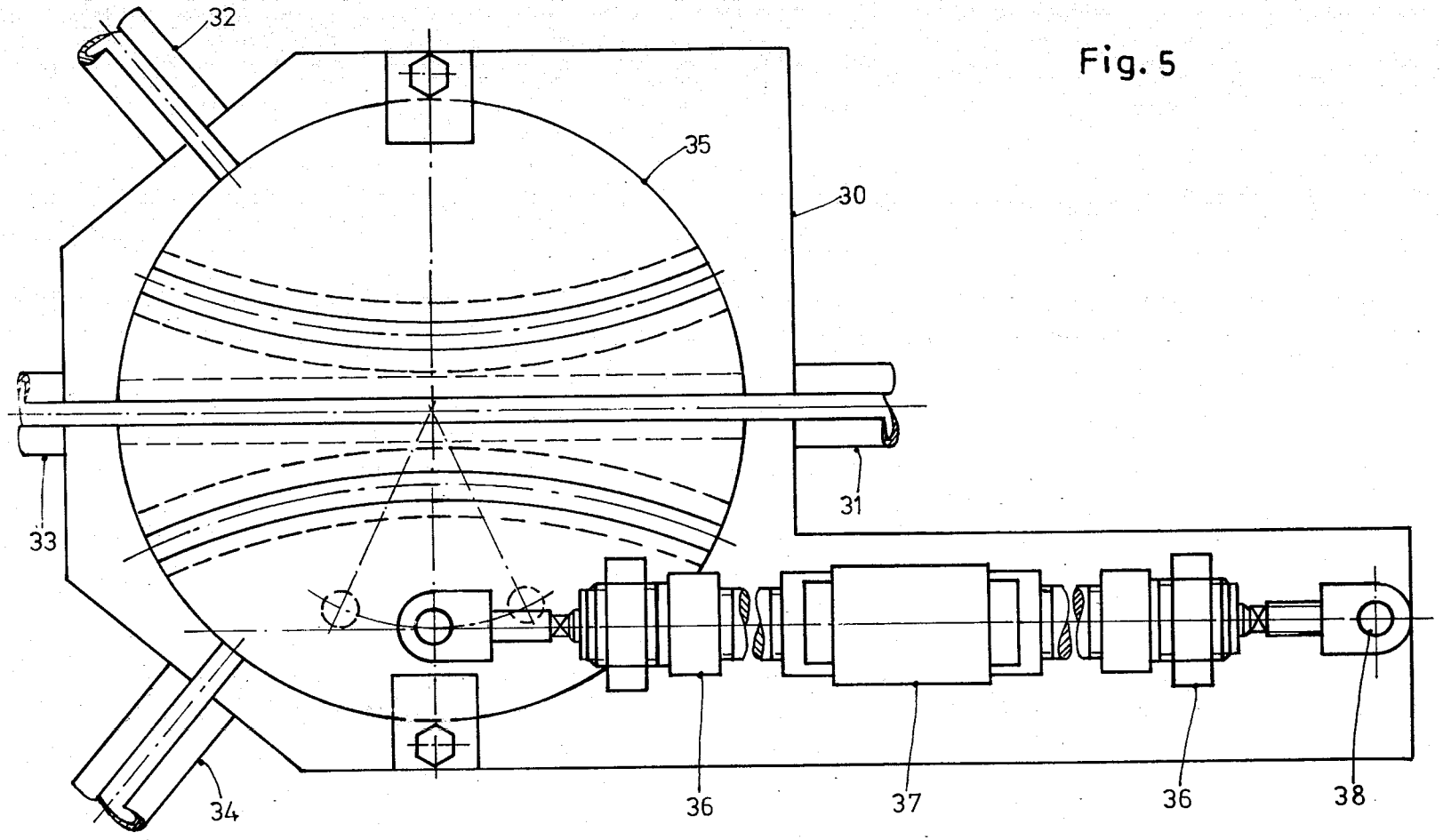
FIG. 5 is a schematic front view for a switch permitting three different threading paths.

Multi-path positioning can be obtained by the system illustrated in FIG. 5, in which a switch 30 permits, selectively, arrangement of the threading path from an input tube 31 to a first output 32, a through-guide output 33 and a second output 34. The respective paths which are selected are controlled by a pneumatic cylinder 36 which is of the double-acting type and which positions the switching disk 35 in either one of three positions. In the position shown in FIG. 5, the threading element is moved in a straight line from the input tube 31 to the in-line output tube 33. Upon control of the pneumatic cylinder 36 to the left-side position, the switching path will extend from the input guide tube 31 to the output guide tube 32; in the right-side position, from the input guide tube 31 to the output guide tube 34. An intermediate two-element part 37 separates the pneumatic cylinder which is pivotably attached to pivot over a pivot axis or pivot point 38. The intermediate element is provided to compensate for differences in longitudinal travel. The respective output positions of the double-acting cylinder are shown in broken lines superimposed on the switching disk or table.

Figure 6:
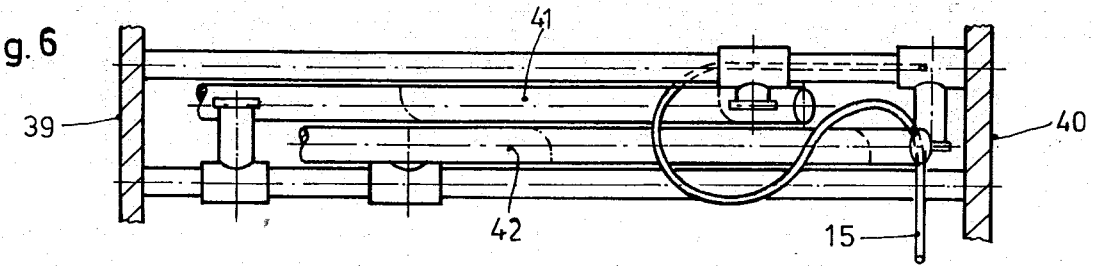
FIG. 6 is a schematic side view of a deflection rod arrangement for the threading cable.
Figure 8:
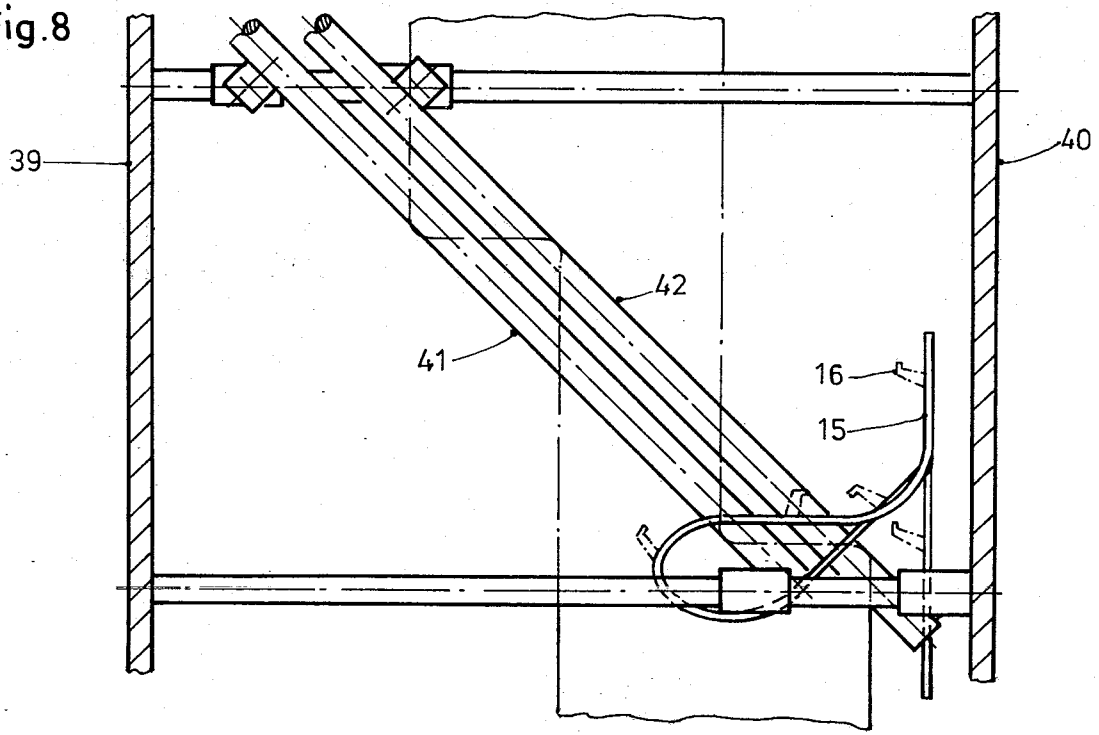
FIG. 8 illustrates another arrangement of deflection rods for the threading cable.
Figure 7:
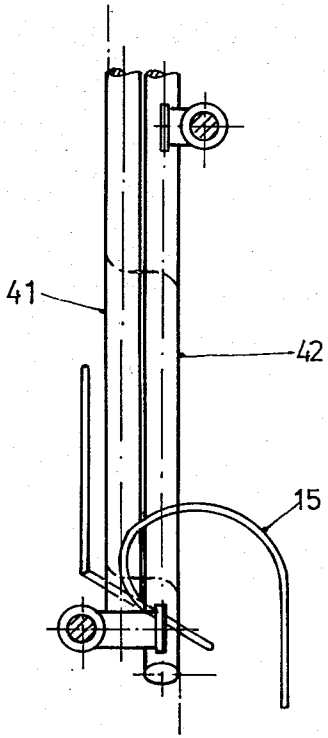
FIG. 7 is another view of the arrangement of FIG. 6.

Use of a cable in accordance with the present invention, that is, a threading element which can be bent in any direction of freedom, permits wrapping or guiding the cable in various ways. FIGS. 6 to 8 illustrate placing the guide path possibilities of the threading element 14 by looping the guide element 14 over turning rods 41, 42 located between side walls 39, 40 of the machine. Due to the cross-sectional shape, permitting bending in any direction, the cable 14 can be guided in various directions in various planes and with various radii of curvature. FIGS. 6 to 8 illustrate possibilities of placement of the cable and the guide tube 15 therefor as selected and as desired.

Figure 9:
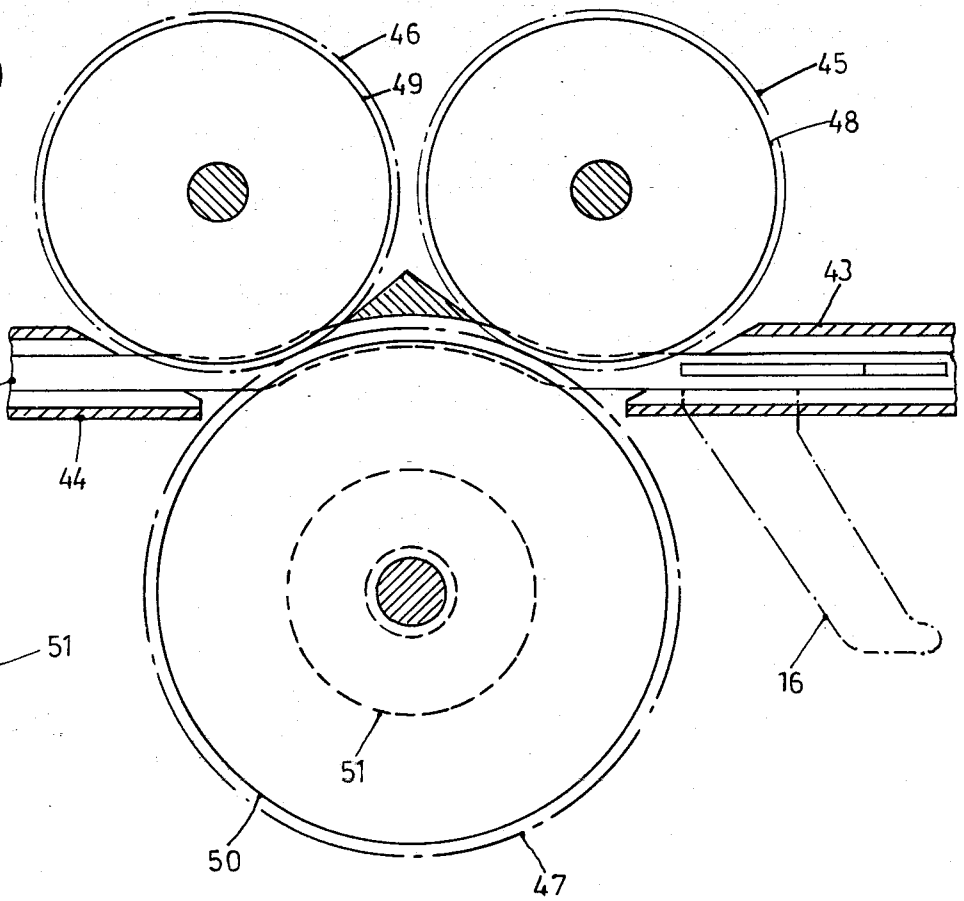
FIG. 9 is a schematic side view of a transport arrangement for the threading cable.
Figure 10:
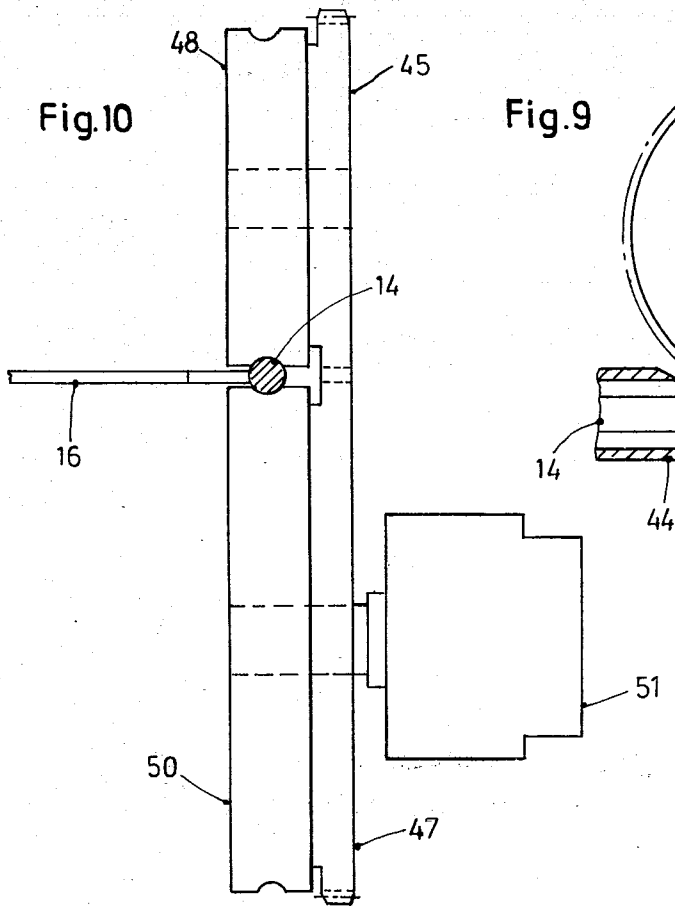
FIG. 10 is a schematic end view of the threading arrangement of FIG. 9.

The cable 14 can be driven in various ways, and FIGS. 9 and 10 illustrate, highly schematically, a front and side view of a suitable and simple drive arrangement. A break in the guide tube sections 43, 44, corresponding, collectively, to the guide tube 15 (FIG. 2), is provided, and friction wheels or sheaves 48, 49 are placed in the gap between the tubes 43, 44. The friction wheels 48, 49 are backed up by a counter wheel 50; the respective friction wheels and counter wheels 48, 49 are driven by gears 45, 46, 47 coupled to a motor 51. The friction wheels 48, 49 guide the cable 14 over a portion of the circumference of the counter friction wheel 50, thus providing for reliable friction engagement and hence powerful push or pull by the cable on a resisting force—for example the web to be threaded through the machine. The guidance of the cable, in a tangential direction, is improved by the arrangement of two driven friction wheels against a counter wheel 50. Preferably, the circumferences of the respective sheaves or wheels 48, 49, 50 are formed with suitable depressions, for example and preferably of essentially semi-circular cross section in order to additional improve the guidance of the cable 14. The ends of tube sections 43, 44 guide the cable 14 tangentially toward and away from the sheaves 48, 49.

Figure 11:
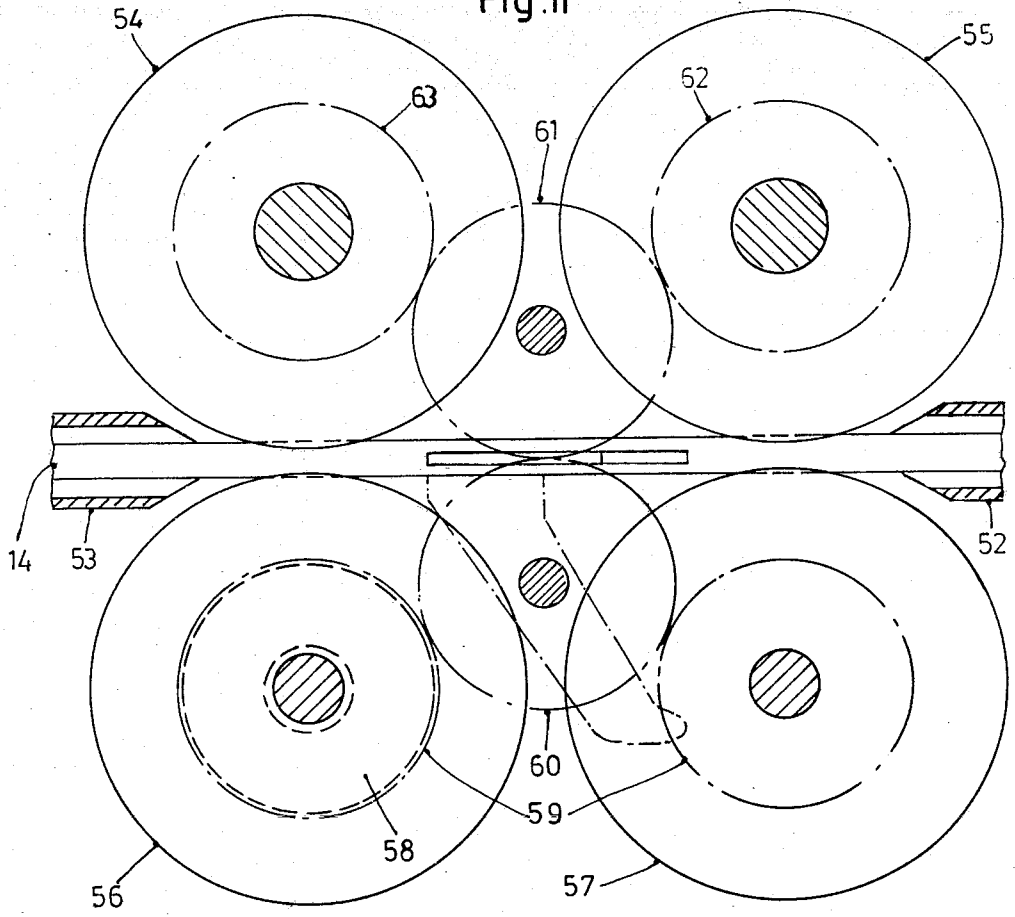
FIG. 11 is a side view of another arrangement for feeding threading cables.
Figure 12:
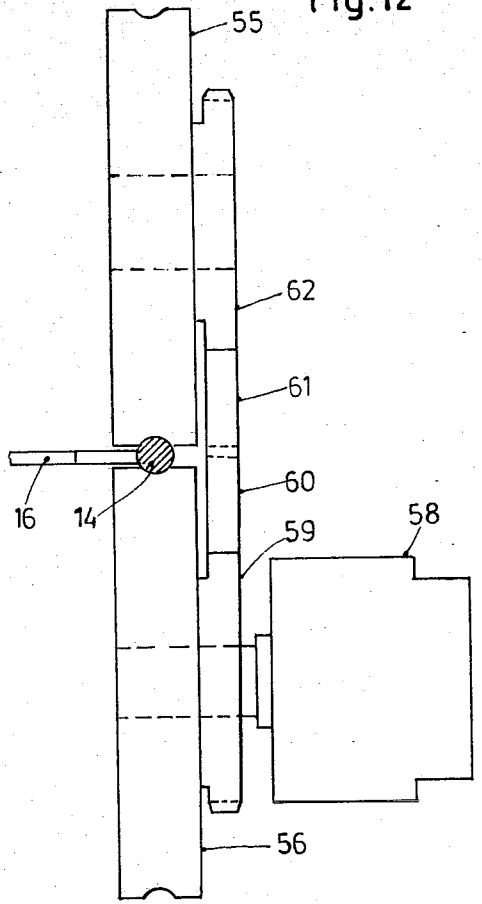
FIG. 12 is a side view of the arrangement of FIG. 11.

A somewhat different and slightly more complex drive arrangement is shown in FIGS. 11 and 12 in which the portion 14 between guide tube sections 52, 53 is driven by friction wheel pairs 54, 56 and 55, 57. A motor 58, coupled to gears 59, 60, 61, 62, 63, provides for force transmission and rotation of the respective friction wheels.

Figure 14:
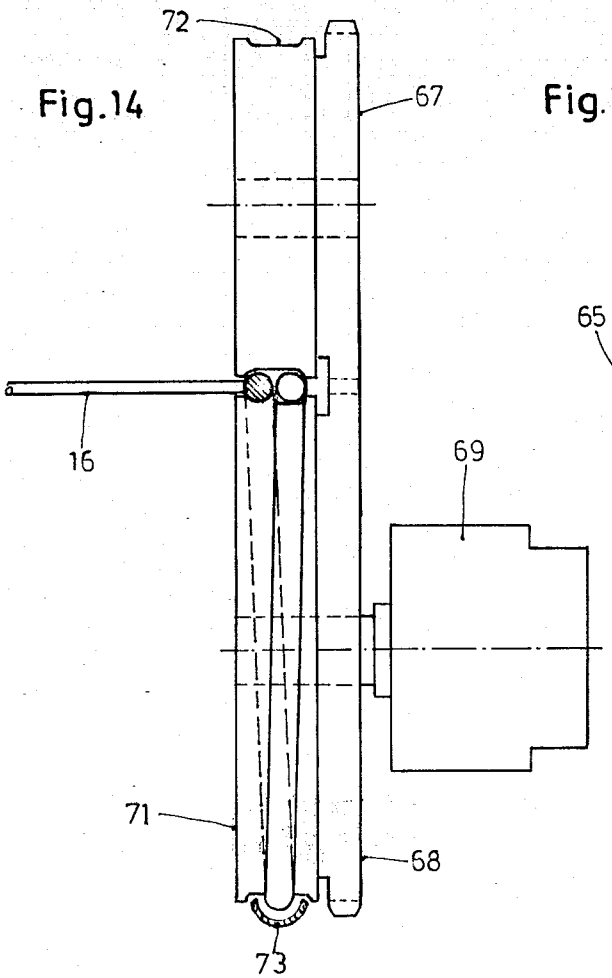

A particularly effective drive arrangement is illustrated in FIGS. 13 and 14, which transfers high driving force or torque on the cable 14. Cable 14 is fed from an output tube section 64 to an inlet guide tube section 65, and guided about a friction wheel 71. Two friction wheels 70, 72 are located against the periphery of friction wheels 71. The wheels 70, 71, 72 are driven over gears 66, 67, 68 by a motor 69. The guidance of the cable is particularly effective by providing a guide collar or sleeve 73 surrounding the friction wheel 71. The cable is wrapped around wheel 71—see FIG. 14—for over 360°. By looping the cable 14 about the friction wheel 71, the frictional force transmission can be calculated in accordance with the function $e^{\mu\alpha}$, in which e is the base of the natural logarithm, $\mu$ the frictional coefficient of the respective materials involved, and $\alpha$ the looping angle. The grooves in the outer friction wheels 70, 72 preferably are of U-shape, in cross section, as best seen in FIG. 14, whereas the groove in friction wheel 71 may be slightly spiraled, or likewise of essentially U-shape, surrounded by the sleeve 73, again of essentially U-shaped cross section, see FIG. 14.

Figure 3:
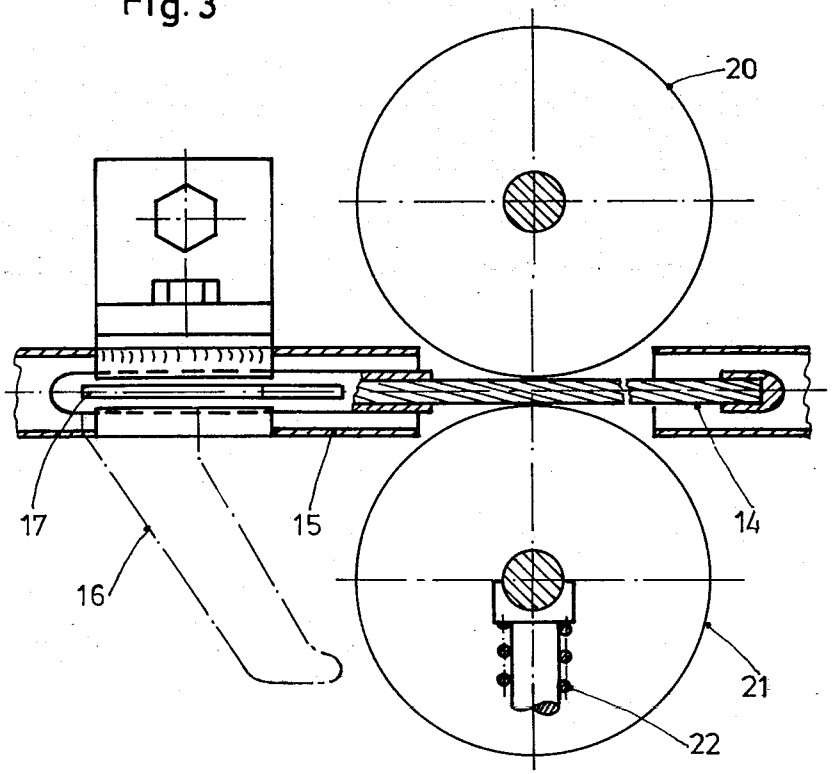
FIG. 3 is a longitudinal, part-sectional view of the threading element of FIG. 2.

The cable 14 itself may have circular cross section, as illustrated in FIGS. 2, 10, 12, 14, or could have polygonal cross-section—as schematically indicated in FIG. 3.

Various changes and modifications may be made within the scope of the inventive concept.

I claim:

1. Web threading apparatus for a rotary printing machine to thread a web of material for printing thereon in a predetermined threading path through the machine, comprising a tubular threading guide (15) of essentially circular cross section including a plurality of threading guide tube sections (44, 43; 52, 53, 64, 65) positioned on the machine in accordance with said path;

an elongated flexible threading element (14) positioned in said tube sections, the threading element having a cross-sectional shape which has the characteristic that the resistance against bending of the element in any direction with respect to the longitudinal extent thereof is at least approximately equal;

the threading guide tube sections being sequentially positioned in accordance with said path, the tube sections being formed with a slit (17) therein;

a pulling hook (16) secured to the threading guide element (14) and extending through said slit in the tube sections;

and at least one friction drive station positioned between adjacent tube sections comprising a plurality of friction drive wheels (48, 49, 50) engaging said flexible threading element, a first one of said friction drive wheels (50) engaging the flexible element (14) from one lateral side, and two friction drive wheels (48, 49) engaging the flexible threading element from the other side and positioned with respect to said first frictional drive wheel to press the flexible threading element against said first frictional drive wheel over a predetermined angular arc position thereof, the end positions of the tube section adjacent said drive wheel being directed essentially tangentially towards the two drive wheels to provide for positive feed and positioning of the threading element within the tube sections and guidance in the zone between said wheels.

2. Apparatus according to claim 1, wherein said threading element comprises a rope or cable.

3. Apparatus according to claim 1, wherein said threading element comprises a spiral.

4. Apparatus according to claim 1, wherein the cross-sectional element of the threading element is polygonal.

5. Apparatus according to claim 1, including switching means (23, 30) interposed in said threading path to permit selective threading of said flexible threading element in accordance with selected path portions.

6. Apparatus according to claim 5, wherein the switching means (23, 30) comprise switching disks (27, 35) having threading path portions secured thereto selectively alignable with said tubular threading guide;

and controllable positioning means (28, 36) selectively positioning said disks in accordance with a selected threading path.

7. Apparatus according to claim 1, wherein the machine includes turning rods;

and at least one of the tube sections is bent or looped around at least one of the turning rods (FIGS. 6–8), the threading element being guided in a convoluted path in accordance with the path of said at least one section.

8. Web threading apparatus for a rotary printing machine to thread a web of material for printing thereon in a predetermined threading path through the machine, comprising a tubular threading guide (15) of essentially circular cross section including a plurality of threading guide tube sections (44, 43; 52, 53, 64, 65) positioned on the machine in accordance with said path;

an elongated flexible threading element (14) positioned in said tube sections, the threading element having a cross-sectional shape which has the characteristic that the resistance against bending of the element in any direction with respect to the longitudinal extent thereof is at least approximately equal;

the threading guide tube sections being sequentially positioned in accordance with said path, the tube sections being formed with a slit (17) therein;

a pulling hook (16) secured to the threading guide element (14) and extending through said slit in the tube sections;

and at least one friction drive station positioned between adjacent tube sections comprising a friction wheel (71), the flexible threading element (14) being looped about said friction wheel;

and at least one counter wheel (70) maintaining the flexible threading element in surface contact engagement with the friction wheel, the end portions of the tube sections adjacent said drive wheel being directed essentially tangentially towards said friction wheel (71) to provide for positive feeding and positioning of the threading element within the tube and guidance about the circumference of said friction wheel.

9. Apparatus according to claim 8, wherein said threading element comprises a rope or cable.

10. Apparatus according to claim 8, wherein said threading element comprises a spiral.

11. Apparatus according to claim 8, wherein the cross-sectional element of the threading element is polygonal.

12. Apparatus according to claim 8, including switching means (23, 20) interposed in said threading path to permit selective threading of said flexible threading element in accordance with selected path portions.

13. Apparatus according to claim 12, wherein the switching means (23, 30) comprise switching disks (27, 35) having threading path portions secured thereto selectively alignable with said tubular threading guide;

and controllable positioning means (28, 36) selectively positioning said disks in accordance with a selected threading path.

14. Apparatus according to claim 8, wherein the machine includes turning rods;

and at least one of the tube sections is bent or looped around at least one of the turning rods (FIGS. 6–8), the threading element being guided in a convoluted path in accordance with the path of said at least one section.

15. Apparatus according to claim 8, further including a loop guide element (73) surrounding at least a portion of the flexible threading element where it is looped about said friction drive wheel (71).

* * * * *

UNITED STATES PATENT AND TRADEMARK OFFICE

CERTIFICATE OF CORRECTION

PATENT NO. : 4,370,927

DATED : Feb. 1, 1983

INVENTOR(S) : Hermann FISCHER

It is certified that error appears in the above—identified patent and that said Letters Patent is hereby corrected as shown below:

After line 16 of column 2 please insert:

Fig. 14 is an end view of the arrangement of Fig. 13.

Signed and Sealed this

*Thirty-first* Day of *May 1983*

[SEAL]

*Attest:*

DONALD J. QUIGG

*Attesting Officer*

*Acting Commissioner of Patents and Trademarks*